US010753080B1

(12) United States Patent
Houston et al.

(10) Patent No.: US 10,753,080 B1
(45) Date of Patent: Aug. 25, 2020

(54) METHOD OF CONSTRUCTING A BUILDING, AND A BUILDING CONSTRUCTION SYSTEM THEREFOR

(71) Applicant: BIG TIME INVESTMENT, LLC, Southfield, MI (US)

(72) Inventors: Stephen T. Houston, Lake Orion, MI (US); Joseph Michael Benvenuto, Monroe, MI (US); Yaroslav Stakhiv, Franklin, MI (US)

(73) Assignee: BIG TIME INVESTMENT, LLC, Southfield, MI (US)

( * ) Notice: Subject to any disclaimer, the term of this patent is extended or adjusted under 35 U.S.C. 154(b) by 0 days.

(21) Appl. No.: 16/370,085

(22) Filed: Mar. 29, 2019

(51) Int. Cl.
*E04B 1/35* (2006.01)
*E04G 21/16* (2006.01)

(52) U.S. Cl.
CPC ..... *E04B 1/3511* (2013.01); *E04B 1/3516* (2013.01); *E04G 21/163* (2013.01); *E04G 21/167* (2013.01); *E04B 2001/3588* (2013.01)

(58) Field of Classification Search
CPC ..... E04B 1/3511; E04B 1/3516; E04B 2001/3588; E04B 1/35; E04B 1/3522; E04B 1/3527; E04G 21/163; E04G 21/167; B66F 7/20; B66F 7/16
See application file for complete search history.

(56) References Cited

U.S. PATENT DOCUMENTS 3,239,990 A * 3/1966 Adler ..... E04B 1/3404 52/745.04
3,260,028 A * 7/1966 Lee ..... E04B 1/3404 52/745.04
3,283,465 A 11/1966 Cheskin
3,355,853 A * 12/1967 Wallace ..... E04B 1/3511 52/745.13
3,527,442 A 9/1970 Korkut
3,729,878 A * 5/1973 Termohlen ..... E04B 2/90 52/122.1
3,822,522 A * 7/1974 Termohlen ..... E04B 2/90 52/745.04
3,895,473 A * 7/1975 Fraser ..... E04B 1/3404 52/745.04
3,936,032 A 2/1976 Waschulzik et al.
3,978,630 A 9/1976 Labie et al.
4,056,256 A 11/1977 Caisley
(Continued)

OTHER PUBLICATIONS

International search report for international application No. PCT/US2020/023675 (dated Jun. 3, 2020).

*Primary Examiner* — Rodney Mintz
(74) *Attorney, Agent, or Firm* — Quinn IP Law

(57) ABSTRACT

A method of constructing a building includes constructing a vertical support core of the building, and attaching a climbing rail to an exterior of the vertical support core. The climbing rail includes holes spaced vertically. A first floor plate is constructed around a periphery of the vertical support core, at a ground elevation, and includes at least one connecting rail having vertically spaced holes. A climbing jack is attached to the climbing rail, and moved vertically upward on the climbing rail to raise the first floor plate to a first floor final elevation. The first floor plate is permanently attached to the climbing rail at the first floor final elevation by inserting a pin through aligned holes in the connecting rail and the climbing rail.

20 Claims, 7 Drawing Sheets

(56) References Cited

U.S. PATENT DOCUMENTS

| | | | | |
|---|---|---|---|---|
| 4,071,988 | A | 2/1978 | Bowes | |
| 4,206,162 | A * | 6/1980 | Vanderklaauw | E04B 1/3511 264/33 |
| 4,301,630 | A * | 11/1981 | Burkland | E04B 1/3511 254/89 H |
| 5,022,199 | A * | 6/1991 | Horii | E04B 1/3527 52/123.1 |
| 5,088,263 | A * | 2/1992 | Horii | E04B 1/3527 52/745.13 |
| 7,784,231 | B2 | 8/2010 | Termohlen | |
| 8,459,901 | B2 | 6/2013 | van Nood et al. | |
| 8,863,474 | B2 * | 10/2014 | Yuan | E04B 1/35 52/122.1 |
| 9,353,537 | B2 * | 5/2016 | Wensel | E04G 23/065 |
| 9,752,316 | B2 | 9/2017 | Thornton | |
| 2008/0276550 | A1 * | 11/2008 | Termohlen | E02D 27/12 52/169.9 |
| 2009/0049762 | A1 | 2/2009 | Termohlen | |
| 2012/0023840 | A1 * | 2/2012 | Yuan | B66F 7/20 52/122.1 |
| 2014/0346421 | A1 * | 11/2014 | Wensel | E04G 23/065 254/89 R |
| 2017/0089062 | A1 * | 3/2017 | Thornton | E04B 1/4114 |

* cited by examiner

METHOD OF CONSTRUCTING A BUILDING, AND A BUILDING CONSTRUCTION SYSTEM THEREFOR

TECHNICAL FIELD

The disclosure generally relates to a method of constructing a building, and a building construction system for constructing the building.

BACKGROUND

Many methods of constructing multi-story buildings exist. Traditionally, multi-story buildings have been constructed from the ground up, in which construction of the building begins on a ground level by attaching higher elevation structural elements on top of previously assembled lower structural elements to construct the building in upward direction, i.e., from bottom up. This construction method requires that the structural elements be lifted by a crane and connected in situ at elevation. This is particularly timely and costly when constructing tall buildings.

A more recent construction method includes constructing a vertical support core of the building. The vertical support core is designed to carry all structural loads of the building. The floor plates, including the roof, are constructed around the base of the vertical support core at ground level, lifted vertically into place with strand jacks located on top of the vertical support core, and then connected to the vertical support core. In this matter, the roof structure is assembled at ground level, lifted to its final elevation, and then attached to the vertical support core. After the roof is attached to the vertical support core, the top floor plate is assembled at ground level, lifted to its final elevation, and then attached to the vertical support core. Subsequent floor plates are assembled and attached to the vertical support core in the same manner in a descending order. By so doing, the roof and the floor plates of the building are constructed in a downward direction, i.e., from top down.

SUMMARY

A method of constructing a building is provided. The method includes constructing a vertical support core of the building. A climbing rail is attached to an exterior of the vertical support core. The climbing rail extends vertically, and is substantially parallel with the vertical support core. A first floor plate is constructed around a periphery of the vertical support core, at a ground elevation. A climbing jack is attached to the climbing rail at an initial jack elevation, which is disposed below the first floor plate, such that the climbing jack supports the first floor plate. The climbing jack is moved vertically upward on the climbing rail to raise the first floor plate to a first floor final elevation. The first floor plate is permanently attached to the climbing rail at the first floor final elevation.

In one aspect of the method of constructing the building, constructing the first floor plate includes constructing a structural support system of the first floor plate to include at least one connecting rail positioned adjacent to and parallel with the climbing rail. In one embodiment, the at least one connecting rail includes a first connecting rail disposed on a first lateral side of the climbing rail, and a second connecting rail disposed on an opposing second lateral side of the climbing rail. Each of the climbing rail and the at least one connecting rail include a plurality of holes spaced vertically relative to each other. A pin is inserted through aligned holes in each of the climbing rail and the at least one connecting rail to connect the first floor plate to the climbing rail. In one aspect of the method of constructing the building, the aligned holes are disposed above the first floor plate, such that the pin may be inserted through the aligned holes from a position above the first floor plate. As such, a construction worker may be positioned above the first floor plate while attaching the first floor plate to the climbing rail, thereby avoiding working underneath the first floor plate until the first floor plate is safely secured to the climbing rail and thereby to the vertical support core.

In one aspect of the method of constructing the building, a hat beam is disposed above and attached to a top of the vertical support core, such that building load forces are transferable between the hat beam and the vertical support core. The climbing rail is attached to the hat beam, such that building load forces are transferable between the climbing rail and the hat beam. The at least one connecting rail is attached to the hat beam, such that the building load forces are transferable between the at least one connecting rail and the hat beam.

In another aspect of the method of constructing the building, constructing the vertical support core includes constructing a foundation of the vertical support core. The foundation is operable to transfer building load forces to ground. The climbing rail is attached to the foundation of the vertical support core, such that building load forces are transferable between the climbing rail and the foundation of the vertical support core. The at least one connecting rail is attached to the foundation of the vertical support core, such that the building load forces are transferable between the at least one connecting rail and the foundation of the vertical support core. By so doing, the building load forces may be transmitted to ground through the vertical support core, the climbing rail, and/or the at least one connecting rail. As such, the building construction system provides redundant load paths to transfer the building load forces to ground.

A building construction system is also provided. The building construction system includes a vertical support core operable to transfer building load forces to ground. A climbing rail is attached to an exterior surface of the vertical support core. The climbing rail extends vertically with and generally parallel to the vertical support core. The climbing rail includes a plurality of holes each spaced vertically relative to each other along the climbing rail. A climbing jack is attached to the climbing rail. A floor plate includes structural support system having at least one connecting rail. The at least one connecting rail is disposed adjacent to and substantially parallel with the climbing rail. The at least one connecting rail includes a plurality of holes, each spaced vertically relative to each other along the at least one connecting rail. The climbing jack is operable to move up the climbing rail to raise the floor plate to a final elevation. A pin is disposed within and extends through one of the holes of the climbing rail and one of the holes of the at least one connecting rail aligned therewith to secure the floor plate to the climbing rail.

In one aspect of the building construction system, a hat beam is disposed above and attached to the vertical support core. Each of the climbing rail and the at least one connecting rail is attached to the hat beam and operable to transmit building load forces therebetween. In another aspect of the building construction system, a foundation supports the vertical support core. Each of the climbing rail and the at least one connecting rail is attached to the foundation and operable to transmit building load forces therebetween. By so doing, the building load forces may be transmitted to ground through the vertical support core, the climbing rail, and/or the at least one connecting rail. As such, the building construction system provides redundant load paths to transfer the building load forces to ground.

In one embodiment of the building construction system, the climbing jack includes a pin climbing jack including an upper post for engaging the holes of the climbing rail, a lower post for engaging the holes of the climbing rail, and a hydraulic jack operable to extend and retract to move the upper post and the lower post away from and toward each other. By sequentially disengaging the upper post from a hole in the climbing rail, extending the hydraulic jack, re-engaging the disengaged upper post into another hole in the climbing rail, disengaging the lower post from a hole in the climbing rail, retracting the hydraulic jack, and then re-engaging the disengaged lower post into another hole in the climbing rail, the climbing jack is able to climb up the climbing rail and raise the floor plate. The process may be executed in reverse to move the climbing jack vertically downward to the initial jack elevation at ground level.

By using the climbing jack to move up the climbing rail in order to raise the floor plate, there is no need to position strand jacks on top of the vertical support core to raise the floor plates. The climbing jacks are much easier to install and remove than the previously used strand jacks, which had to be placed on top of the vertical support core.

The above features and advantages and other features and advantages of the present teachings are readily apparent from the following detailed description of the best modes for carrying out the teachings when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Figure 1:
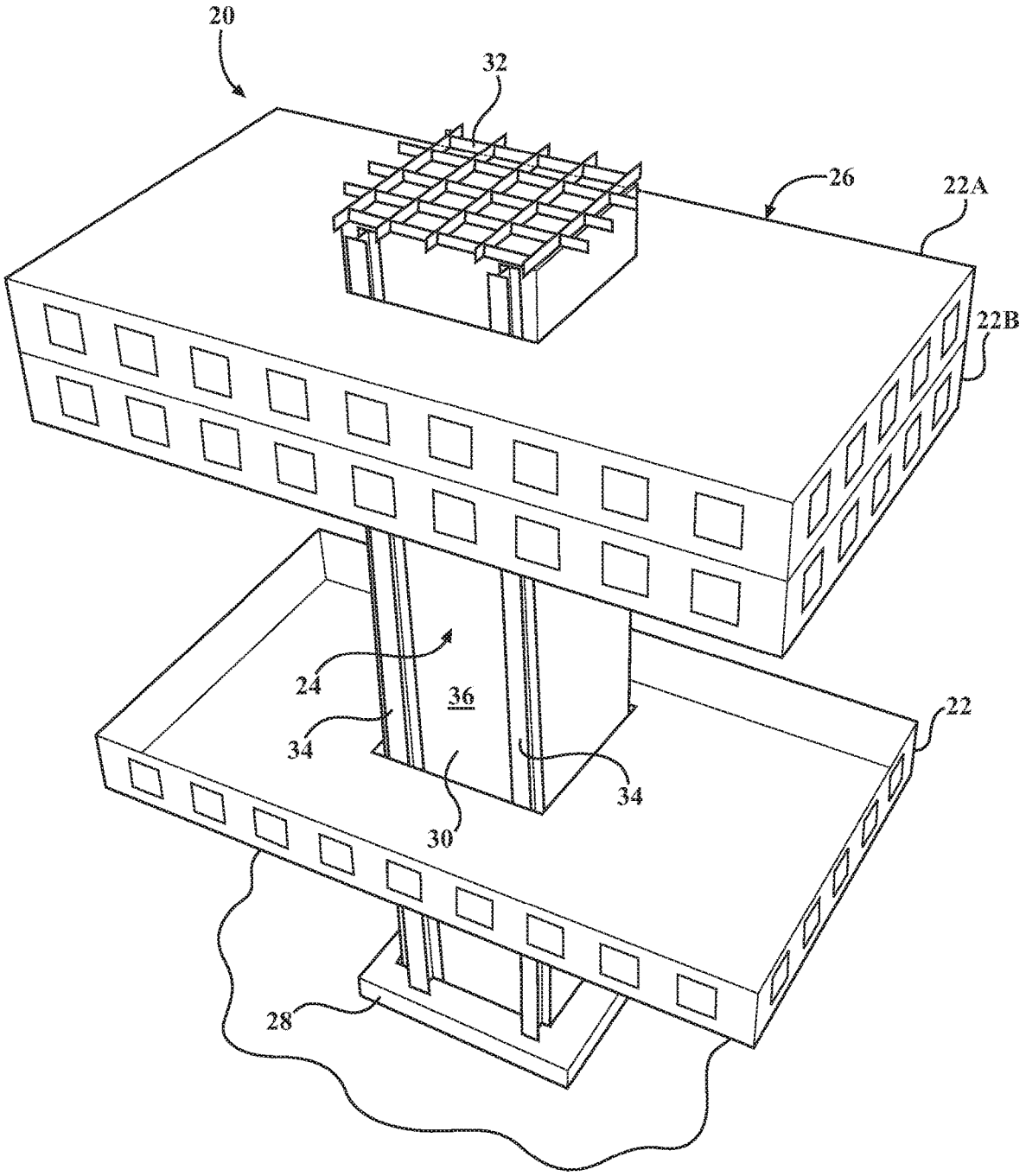
FIG. 1 is a schematic perspective view of a building construction system showing a building partially constructed.

Referring to the Figures, wherein like numerals indicate like parts throughout the several views, a building construction system is generally shown at 20. Referring to FIG. 1, the building construction system 20 is used for constructing a building 26 using a top down process, in which a vertical support core 24 is first constructed, and individual floor plates 22 are constructed at ground level, raised into position, and then attached to the vertical support core 24. Subsequent floor plates 22 are assembled and attached to the vertical support core 24 in the same manner in a descending order. By so doing, the roof and the floor plates 22 of the building 26 are constructed in a downward direction, i.e., from top down.

As used herein, the term "floor plate 22" may include all structural or frame members 56, e.g., joists and/or purlins, flooring, e.g., concrete floor, interior walls, exterior curtain walls, modular room subassemblies, e.g., a lavatory module, utilities, etc., that form a floor or level of the building 26. The term "floor plate 22" may include a plate for a roof of the building 26, as well as a plate for a floor or level of the building 26. Accordingly, it should be appreciated that the term "floor plate 22" is used herein to refer to both a roof structure for the roof of the building 26, as well as a floor structure for a floor or level of the building 26. As used herein and shown in the Figures, the reference numeral 22 may refer and indicate any floor plate 22 of the building 26, whereas the reference numeral 22A refers to and indicates a first floor plate 22A, and the reference numeral 22B refers to and indicates a second floor plate 22B.

The vertical support core 24 is designed to carry all of the building 26 load forces. As such, the vertical support core 24 transfers the vertical load from each floor plate 22 to a foundation 28 of the vertical support core 24, which supports the building 26 on the soil, i.e., ground. The foundation 28 of the vertical support core 24 may be constructed in a manner suitable for the specific soil, weather, and seismic conditions of the building site. Additionally, the foundation 28 and the vertical support core 24 are designed to carry any bending moments introduced into the building 26, such as from a wind load or a seismic load. The specific type and construction of the foundation 28 of the vertical support core 24 is not pertinent to the teachings of this disclosure, is well known to those skilled in the art, and is therefore not described in detail.

The vertical support core 24 may be constructed using a vertical slip form system that forms a wall 30 of the vertical support core 24 from a hardenable material, while moving vertically upward from a ground elevation to a finished top elevation. The hardenable material may include, but is not limited to, a concrete mixture or other similar composition. The wall 30 of the vertical support core 24 may include reinforcing steel as understood in the art. The specific design and construction of the vertical support core 24 using the vertical slip form system are known to those skilled in the art, is dependent upon the specific application and location, is not pertinent to the teachings of this disclosure, and is therefore not described in detail herein.

Alternatively, the vertical support core 24 may be constructed using some other process. For example, the vertical support core 24 may be constructed using pre-formed molds that are stacked together to form a cavity. Reinforcing steel may be added to the cavity as needed, and a hardenable material may be poured into the cavity to form the wall 30 of the vertical support core 24. An example of a pre-formed mold system may include, but is not limited to, the REDI-COR Modular Steel Form System by Vulcraft. It should be appreciated that the vertical support core 24 may be constructed in some other manner not specifically described herein.

A hat beam 32 is disposed above and on top of the vertical support core 24, and is attached to the vertical support core 24. The hat beam 32 is attached to the vertical support core 24 in a manner that enables the building 26 load forces to be transferred between the vertical support core 24 and the hat beam 32. The hat beam 32 may include a structural component, such as a steel beam, that is sized to carry the building 26 load forces. The specific manner in which the hat beam 32 is attached to the top of the vertical support core 24 is not pertinent to the teachings of this disclosure, are well known by those skilled in the art, and is therefore not described in detail herein.

As shown in FIG. 1, a climbing rail 34 is attached to an exterior surface 36 of the vertical support core 24. It should be appreciated that multiple climbing rails 34 may be attached to the vertical support core 24. For example, a climbing rail 34 may be attached at each corner of the vertical support core 24, or on each side of the vertical support core 24. While the detailed description only describes a single climbing rail 34, it should be appreciated that the description applies to all climbing rails 34 used for a particular application. The number of climbing rails 34 is dependent upon the particular application, size of the building 26, number of vertical support cores 24, etc.

Figure 2:
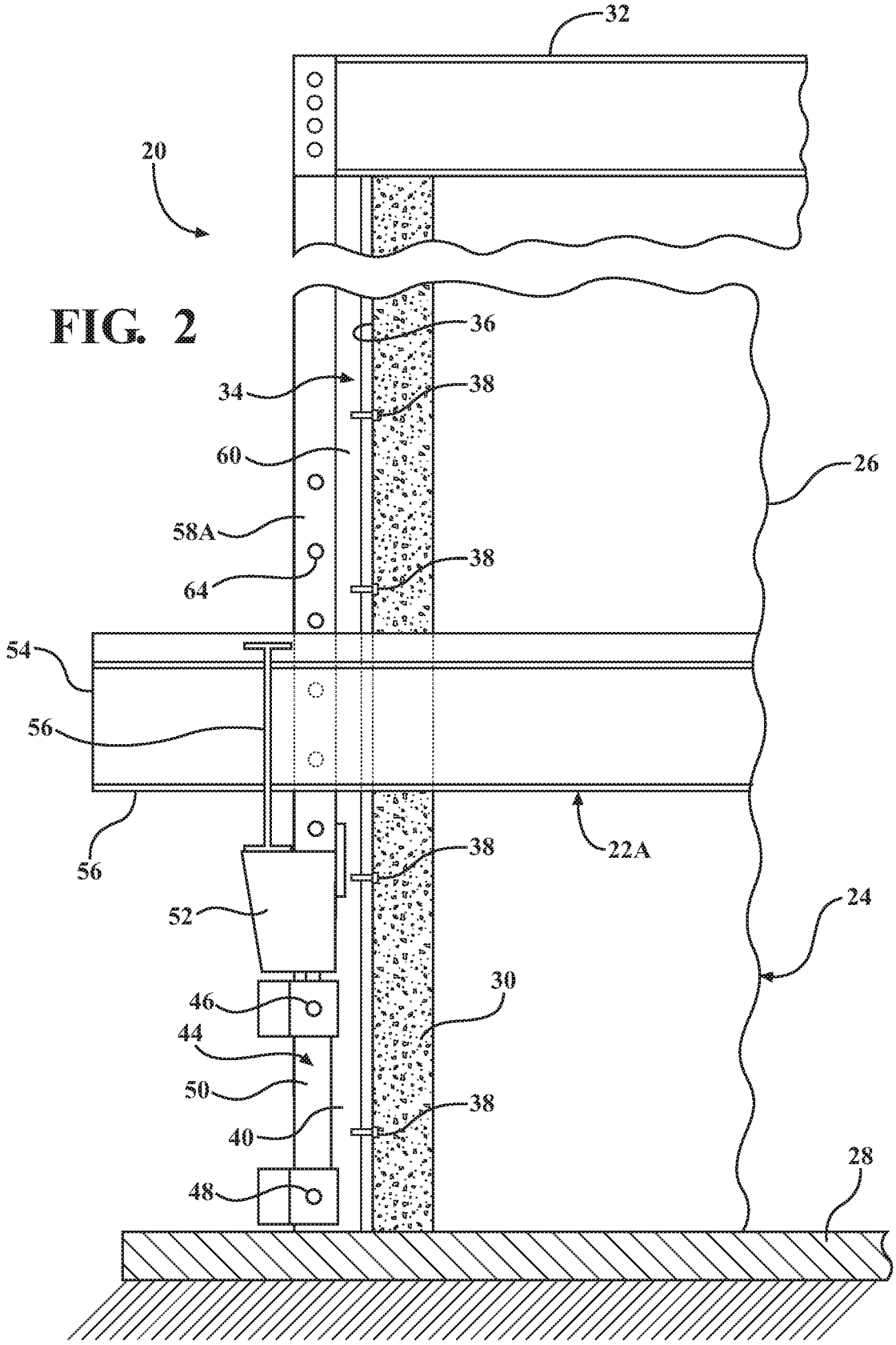
FIG. 2 is a schematic side view of the building construction system showing a first floor plate at a ground elevation.

Referring to FIG. 2, the climbing rail 34 extends vertically from the foundation 28 to the hat beam 32, and extends substantially parallel to the vertical support core 24. The climbing rail 34 is attached to the vertical support core 24 using a plurality of rigid connections 38. Each rigid connection 38 securely and permanently attaches the climbing rail 34 to the vertical support core 24. The rigid connection 38 may include any type of connection that securely attaches the climbing rail 34 to the vertical support core 24. For example, the climbing rail 34 may be bolted to the vertical support core 24 using threaded rod embedded in the vertical support core 24. Alternatively, steel blocks may be formed into the vertical support core 24 and the climbing rail 34 welded to the steel blocks. Those skilled in the art shall appreciated that many different attachment processes/systems are available and may be sued to securely and permanently attach the climbing rail 34 to the vertical support core 24.

The climbing rail 34 is further attached to the hat beam 32 and the foundation 28. The climbing rail 34 may be attached to the hat beam 32 and the foundation 28 using a suitable process that enables building 26 load forces to be transmitted between the climbing rail 34 and the hat beam 32, and between the climbing rail 34 and the foundation 28. For example, the climbing rail 34 may be attached to the hat beam 32 and the foundation 28 using brackets bolted and/or welded to each other. The specific manner in which the climbing rail 34 is attached to the hat beam 32 and the foundation 28 is understood by those skilled in the art, is not pertinent to the teachings of this disclosure, and is therefore not described in detail herein.

The climbing rail 34 includes a web 40 forming a plurality of holes 42. In one embodiment, each of the holes 42 is a through-hole. Each of the holes 42 of the climbing rail 34 is spaced vertically relative to the other holes 42 of the climbing rail 34 along the vertical length of the climbing rail 34. The spacing between adjacent holes 42 in the climbing rail 34 is dependent upon the specific application. Additionally, the size of each of the holes 42 in the climbing rail 34 is dependent upon the specific application. The function of the holes 42 in the climbing rail 34 is described in greater detail below.

Figure 7:
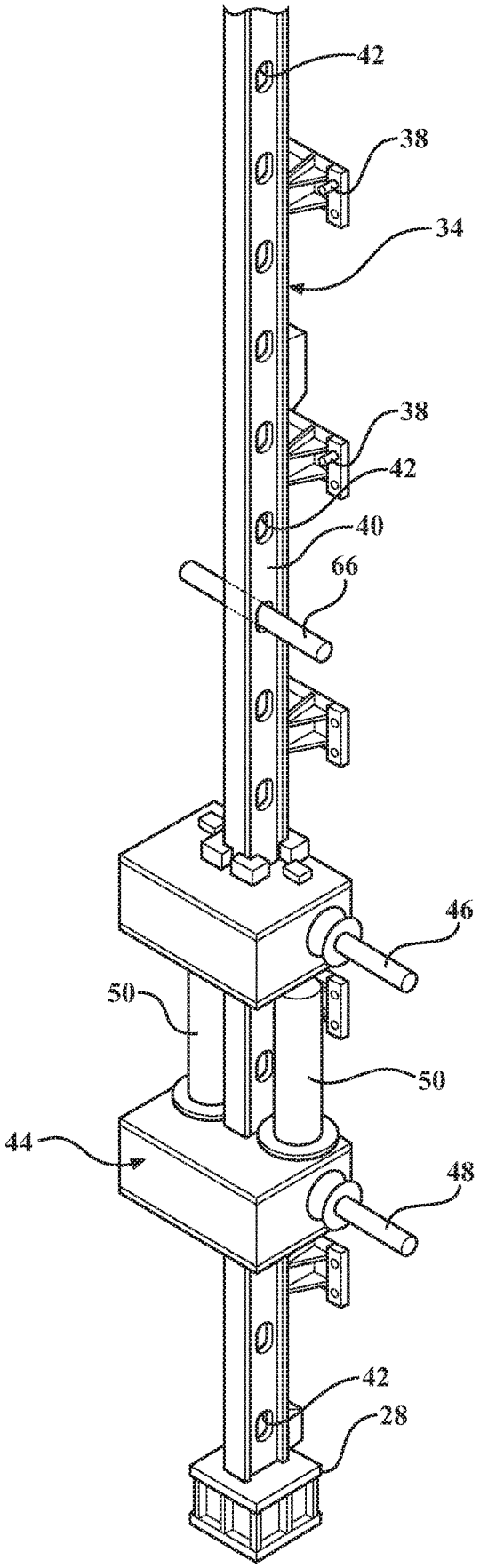
FIG. 7 is a schematic perspective view of a climbing jack on the climbing rail.

Referring to FIGS. 2 and 7, the building construction system 20 includes a climbing jack 44 that is attached to the climbing rail 34. The climbing jack 44 is operable to move up the climbing rail 34 to raise the individual floor plates 22 to their respective final elevations. The climbing jack 44 may include a jack that is capable of pushing or pulling a heavy load up the climbing rail 34 to raise the individual floor plates 22. For example, the climbing jack 44 may include, but is not limited to, a pin climbing jack 44.

As is understood by those skilled in the art, the pin climbing jack 44 includes an upper post 46 for engaging the holes 42 of the climbing rail 34, a lower post 48 for engaging the holes 42 of the climbing rail 34, and a hydraulic jack 50 operable to extend and retract to move the upper post 46 and the lower post 48 away from and toward each other. In operation, the pin climbing jack 44 sequentially disengages the upper post 46 from a hole 42 in the climbing rail 34, extends the hydraulic jack 50, re-engages the disengaged upper post 46 into another hole 42 in the climbing rail 34, disengages the lower post 48 from a hole 42 in the climbing rail 34, retracts the hydraulic jack 50, and then re-engages the disengaged lower post 48 into another hole 42 in the climbing rail 34, to climb up the climbing rail 34 and raise the individual floor plates 22. The process may be executed in reverse to move the climbing jack 44 vertically downward to an initial jack elevation at ground level.

As shown in FIG. 2, in some embodiments, a push block 52 may be positioned between and interconnect the climbing jack 44 and an individual floor plate 22 being lifted while the climbing jack 44 is raising the respective floor plate 22 to the final elevation of the respective floor plate 22. The push block 52 may include any structure capable of supporting and securely connecting the individual floor plate 22 being lifted and the climbing jack 44.

Referring to FIG. 2, each floor plate 22 includes a structural support system 54. The structural support system 54 may include, but is not limited to, a plurality of frame members 56 that are attached together. The frame members 56 may include, for example, structural steel members such as I-beams, channel beams, etc., which form the structural support system 54 for the respective floor plate 22. The frame members 56 may be attached together in any suitable manner, such as but not limited to, bolted connections and/or welded connections.

The structural support system 54 includes at least one connecting rail 58A, 58B. In the embodiment that is illustrated in the Figures, with reference to FIG. 3, the at least one connecting rail includes a first connecting rail 58A disposed on a first lateral side 60 of the climbing rail 34, and a second connecting rail 58B disposed on an opposing second lateral side 62 of the climbing rail 34. However, it should be appreciated that the connecting rail 58A, 58B may include only a single connecting rail 58A, 58B, or more than the two connecting rails 58A, 58B shown in the Figures and described herein. The connecting rails 58A, 58B are fixedly attached to the frame members 56 of the structural support system 54, such that the connecting rails 58A, 58B of each floor plate 22 are operable to carry and/or transfer the building 26 load for that respective floor plate 22. The connecting rails 58A, 58B may be attached to the structural support system 54 in a suitable manner, such as but not limited to, a bolted connection and/or a welded connection.

Figure 3:
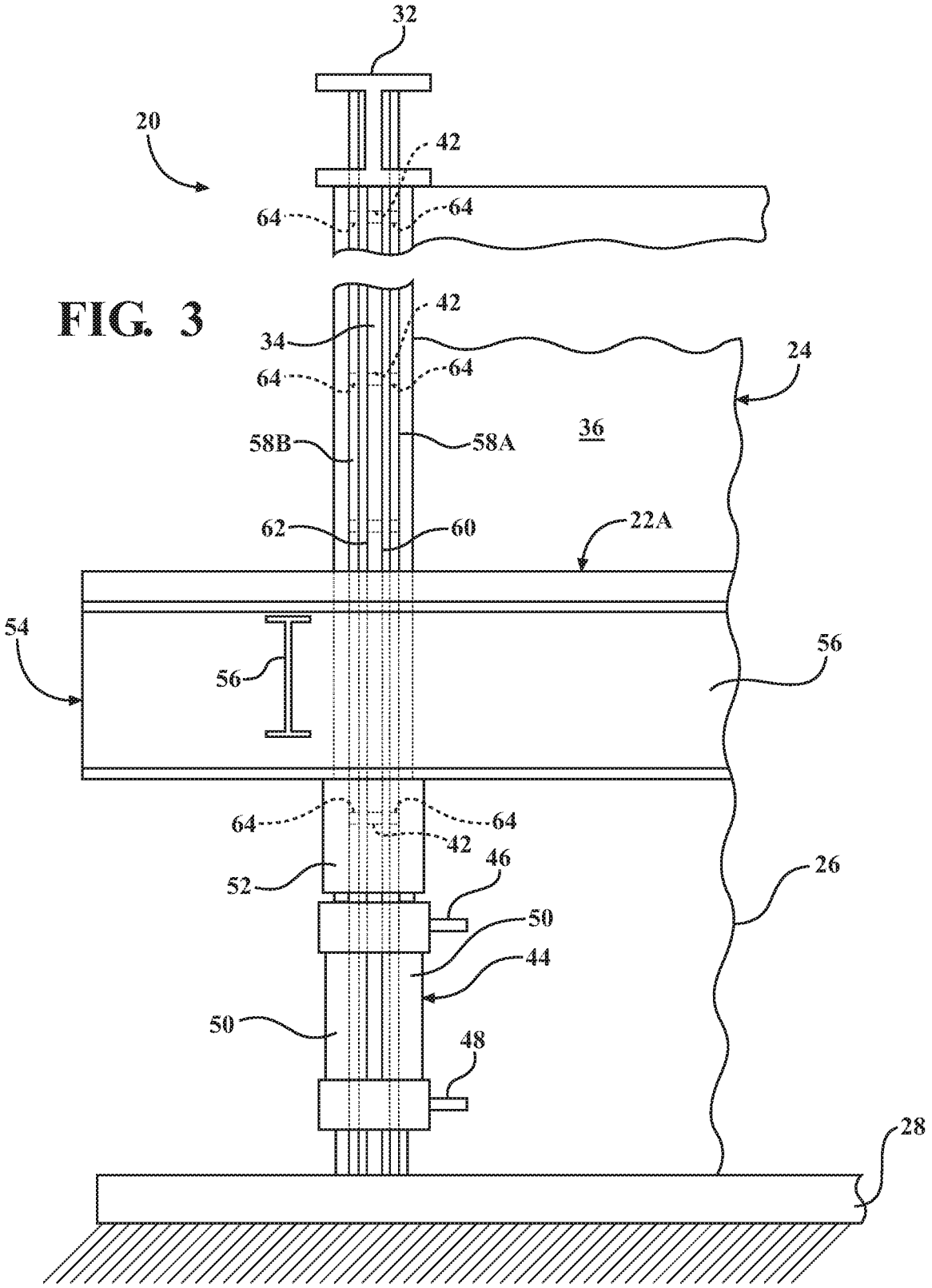
FIG. 3 is a schematic front side view of the building construction system showing the first floor plate at the ground elevation.

Referring to FIGS. 2 and 3, the connecting rails 58A, 58B are disposed adjacent to and substantially parallel with the web 40 of the climbing rail 34. Each of the connecting rails 58A, 58B includes a portion forming a plurality of holes 64. Each of the holes 64 of the respective connecting rails 58A, 58B is spaced vertically relative to the other holes 64 of the respective connecting rails 58A, 58B along a vertical length of the respective connecting rails 58A, 58B. The spacing between adjacent holes 64 in the connecting rails 58A, 58B is dependent upon the specific application. Additionally, the size of each of the holes 64 in the connecting rails 58A, 58B is dependent upon the specific application. The holes 64 of the first connecting rail 58A are vertically aligned with the holes 64 of the second connecting rail 58B, such that a transverse axis perpendicular to the climbing rail 34 and the connecting rails 58A, 58B passes through a center of an aligned pair of holes 64 in first connecting rail 58A and the second connecting rail 58B. Additionally, the vertical distance between the holes 64 in the connecting rails 58A, 58B may be identical to the vertical distance between the holes 42 in the climbing rail 34.

Figure 4:
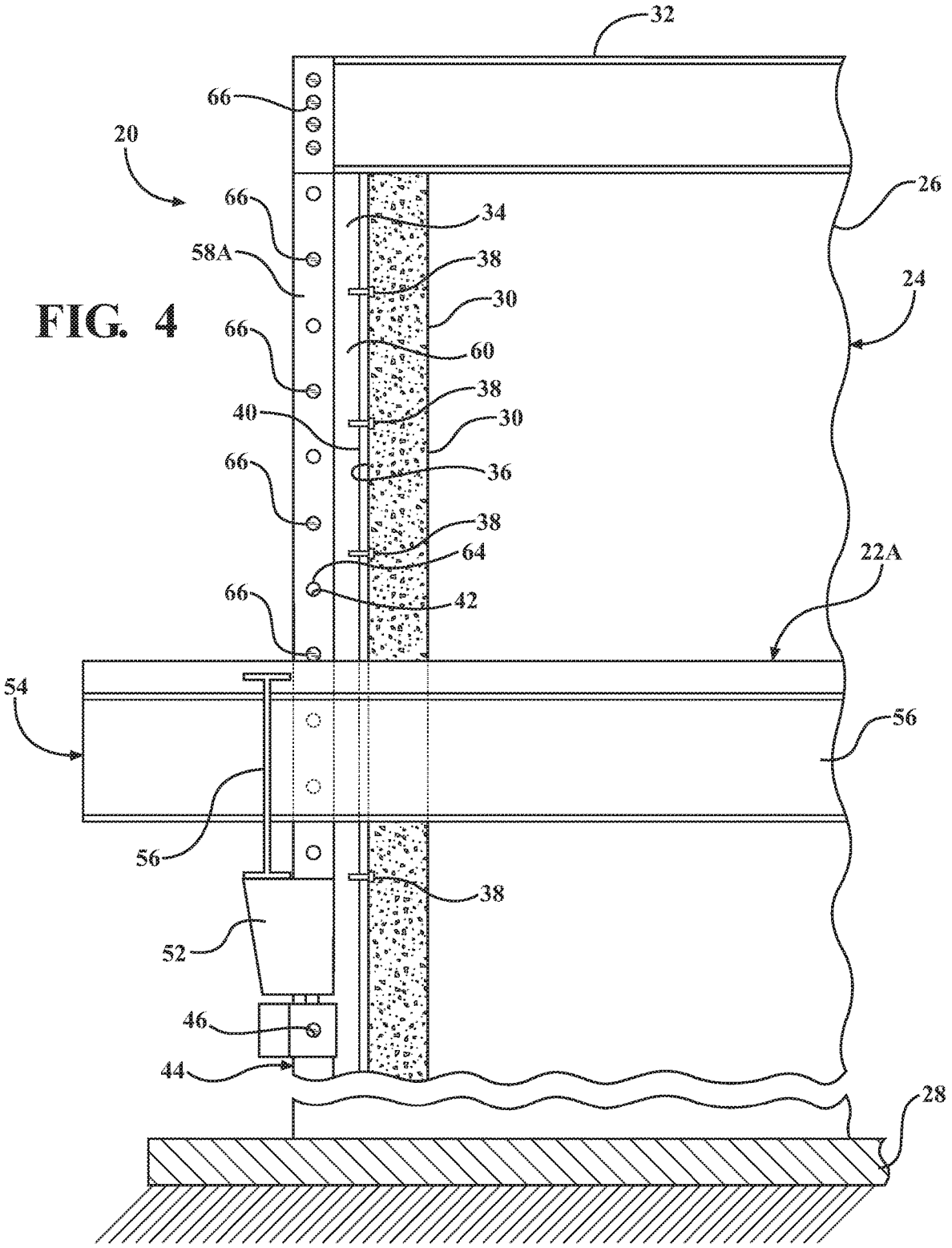
FIG. 4 is a schematic side view of the building construction system showing the first floor plate at a first floor final elevation.
Figure 5:
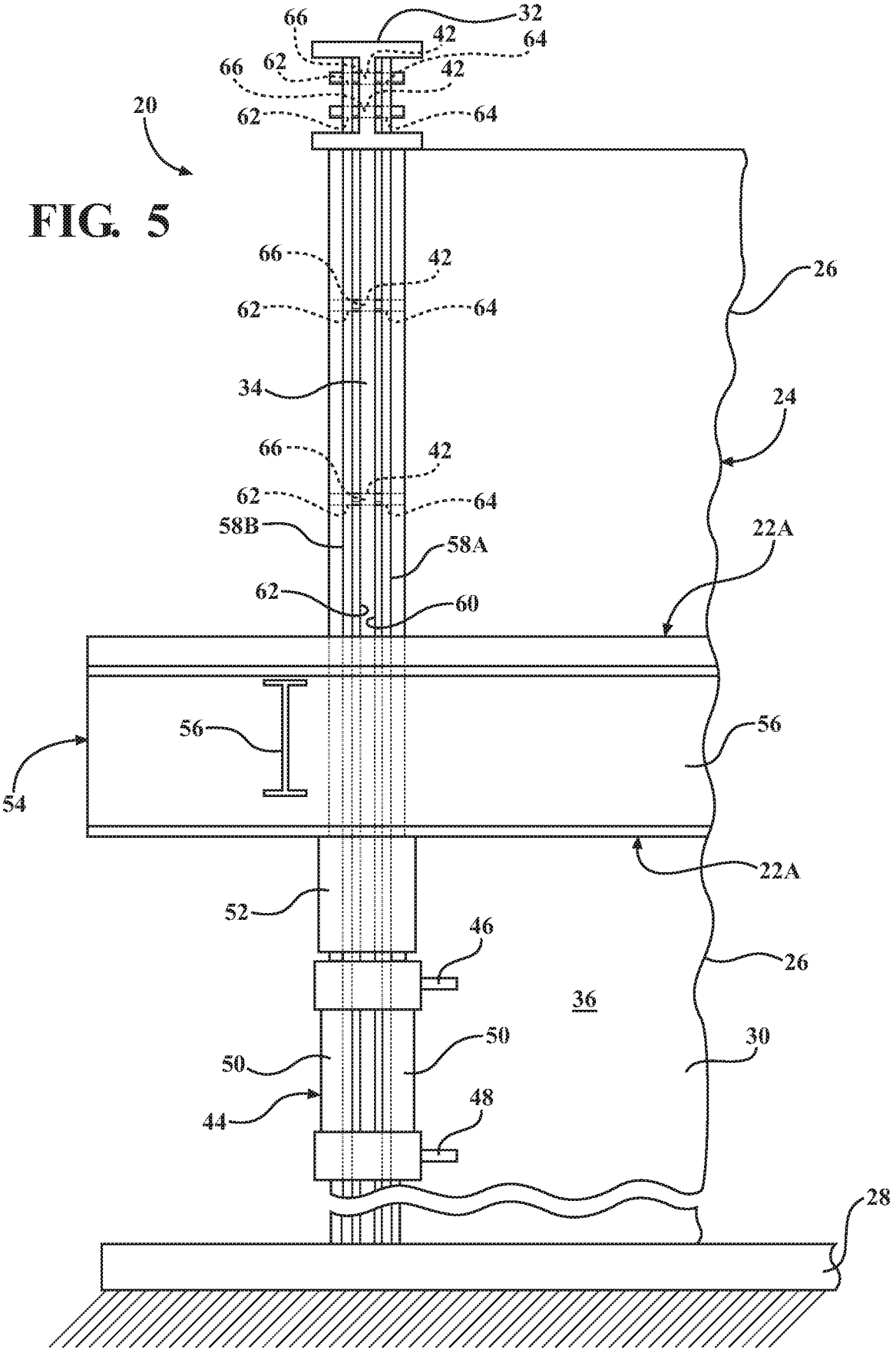
FIG. 5 is a schematic front side view of the building construction system showing pin interconnecting a pair of connecting rails to a climbing rail.
Figure 6:
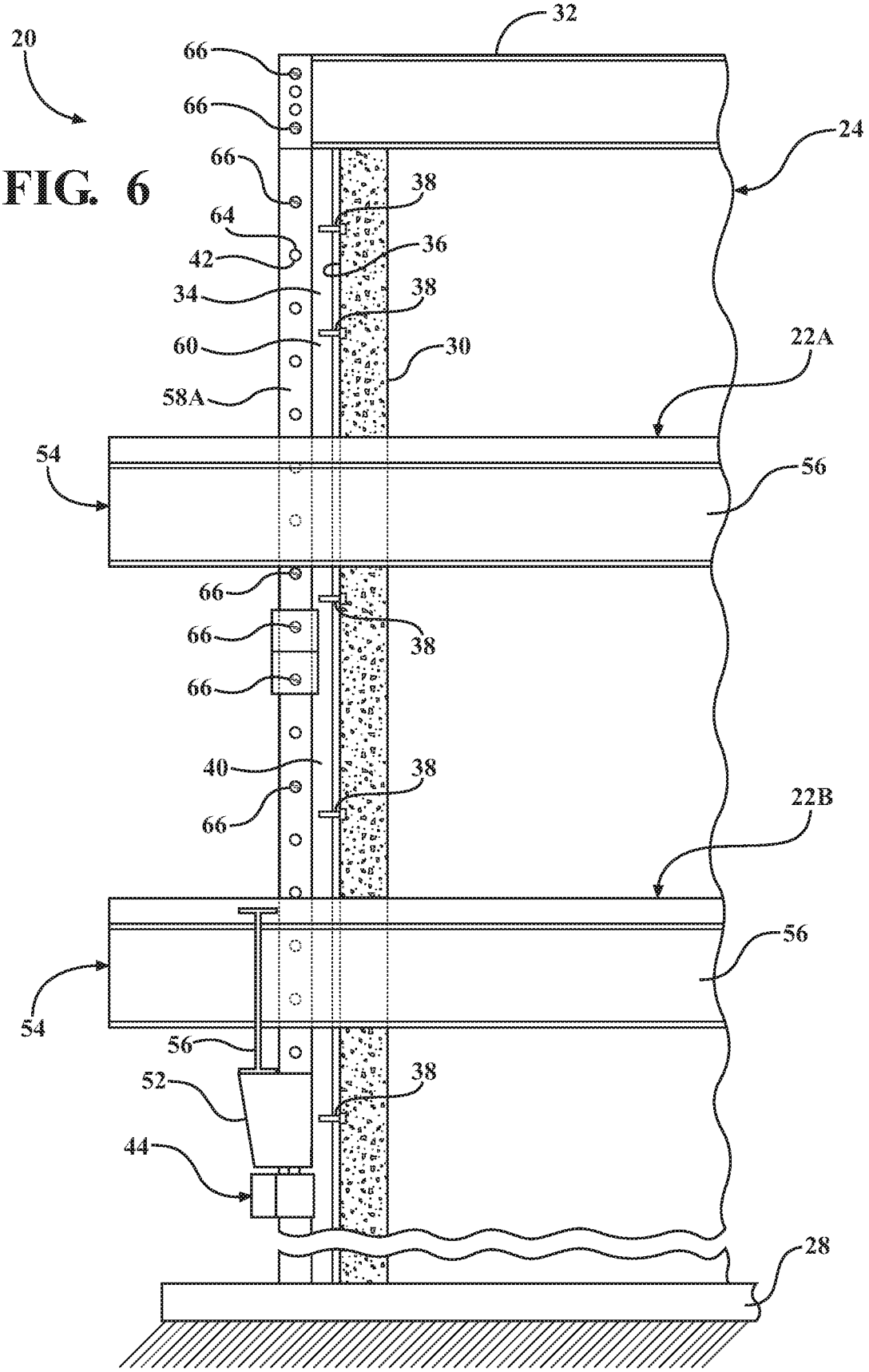
FIG. 6 is a schematic side view of the building construction system showing a second floor plate at a second floor final elevation.

Referring to FIGS. 4-6, the building construction system 20 further includes a plurality of pins 66. Each pin 66 is disposed within and extends through one of the holes 42 of the climbing rail 34 and one of the holes 64 of the connecting rails 58A, 58B aligned therewith, to secure the floor plate 22 to the climbing rail 34. It should be appreciated that each individual floor plate 22 may be attached to the climbing rail 34 with multiple pins 66, such that the pins 66 transfer the load from each individual floor plate 22 to the climbing rail 34. Additionally, connecting rails 58A, 58B from adjoining floor plates 22 above and below may be attached together, such that when the building 26 is complete, the connecting rails 58A, 58B form a structural load path between the hat beam 32 and the foundation 28.

As shown in FIG. 6, the connecting rails 58A, 58B may be attached to the hat beam 32 and the foundation 28. By connecting the connecting rails 58A, 58B from each individual floor plate 22 together, the connecting rails 58A, 58B may be attached together to form a continuous column extending between the hat beam 32 and the foundation 28. In other words, the connecting rails 58A, 58B of the floor plate 22 forming the roof may be attached to the hat beam 32, and the connecting rails 58A, 58B of the lowest level floor plate 22 may be attached to the foundation 28, with the connecting rails 58A, 58B of the intervening floor plates 22 connected together to form the continuous column. The connecting rails 58A, 58B may be attached together, and to the hat beam 32 and the foundation 28, using a suitable process that enables building 26 load forces to be transmitted between the connecting rails 58A, 58B and the hat beam 32, and between the connecting rails 58A, 58B and the foundation 28. For example, the connecting rails 58A, 58B may be attached together, and to the hat beam 32 and the foundation 28 using brackets bolted and/or welded to each other. The specific manner in which the climbing rails 34 are attached to each other, and to the hat beam 32 and the foundation 28, is understood by those skilled in the art, is not pertinent to the teachings of this disclosure, and is therefore not described in detail herein.

A method of constructing the building 26 using the building construction system 20 described above, is also provided. The method includes constructing the foundation 28 and the vertical support core 24 of the building 26. As noted above, the vertical support core 24 is designed to carry the building 26 load forces from the floor plates 22 to the foundation 28. The foundation 28 transfers the building 26 load forces to the ground. The specific design of the foundation 28 and the vertical support core 24 is dependent upon the specifics of the building 26, location, soil type, etc., are well understood by those skilled in the art. The foundation 28 and the vertical support core 24 may be constructed in any suitable manner. The processes used to construct the foundation 28 and the vertical support core 24 ware well understood by those skilled in the art. Therefore, the design and process of constructing the foundation 28 and the vertical support core 24 are not described in detail herein.

Once the vertical support core 24 has been constructed, the hat beam 32 is positioned on top of the vertical support core 24, and is fixedly and permanently attached to the vertical support core 24. The hat beam 32 is attached to the vertical support core 24 in a manner that allows the building 26 load forces to be transferable between the hat beam 32 and the vertical support core 24. The manner in which the hat beam 32 is attached to the vertical support core 24 is within the knowledge of those skilled in the art, and is therefore not described in detail herein.

The climbing rail 34 is then attached to an exterior of the vertical support core 24. As noted above, the climbing rail 34 extends vertically, and is substantially parallel with the vertical support core 24. The climbing rail 34 is further attached to the hat beam 32 and the foundation 28. The climbing rail 34 may be attached to the vertical support core 24, the hat beam 32 and the foundation 28, in any suitable manner that fixedly and permanently attaches the climbing rail 34 to the hat beam 32 the vertical support core 24, and the foundation 28, and allows the building 26 load forces to be transmitted therebetween. Accordingly, the building 26 load forces may be transmitted from the climbing rail 34 directly to the foundation 28, from the climbing rail 34 to the hat beam 32, from the hat beam 32 to the vertical support core 24, and then from the vertical support core 24 to the foundation 28. As such, it should be appreciated that the climbing rail 34 is a structural load bearing component of the vertical support core 24 and/or of the building 26, and may be used to transfer the building 26 load forces to the foundation 28.

The climbing jack 44 may then be attached to the climbing rail 34 at an initial jack elevation. The initial jack elevation is an elevation that is below an assembly elevation of the floor plates 22. As such, the climbing jack 44 may at least partially support the individual floor plates 22 during assembly of the individual floor plates 22, and supports the floor plates 22 while raising them to their respective final elevation.

The climbing jack 44 may be attached to the climbing rail 34 in any suitable manner. The manner in which the climbing jack 44 is attached depends upon the specific type and operation of the climbing jack 44. For example, if the climbing jack 44 is embodied as the pin climbing jack 44 described herein, then the lower post 48 and the upper post 46 of the pin climbing jack 44 may be inserted through respective holes 42 in the climbing rail 34 to attach the climbing jack 44 to the climbing rail 34.

Referring to FIGS. 2 and 3, the first floor plate 22A is constructed around a periphery of the vertical support core 24 at ground elevation. Constructing the first floor plate 22A includes constructing the structural support system 54 of the first floor plate 22A, which includes connecting the connecting rails 58A, 58B to the frame members 56 of the structural support system 54. The connecting rails 58A, 58B are positioned adjacent to and parallel with the climbing rail 34. In the illustrated embodiment, the first connecting rail 58A is positioned on the first lateral side 60 of the climbing rail 34, and the second connecting rail 58B is positioned on the second lateral side 62 of the climbing rail 34. In the embodiment described and illustrated herein, the connecting rails 58A, 58B include a portion that extends upward from the first floor plate 22A for attachment to the hat beam 32 or a higher level floor plate 22. Additionally, the connecting rails 58A, 58B may include a shorter portion that extends downward from the first floor plate 22A to attachment to a subsequent lower level floor plate 22, e.g., a second floor plate 22B described below, or to the foundation 28.

Referring to FIGS. 4 and 5, once the first floor plate 22A is constructed, the climbing jack 44 is moved vertically upward on the climbing rail 34 to raise the first floor plate 22A to a first floor final elevation. As is understood by those skilled in the art, the climbing jack 44 is computer controlled to move up or down the climbing rail 34. For example, the computer controls engagement and/or disengagement of the upper post 46 and/or the lower post 48 into and out of the holes 42 of the climbing rail 34, as well as the extension and retraction of the hydraulic jack 50, to move the climbing jack 44 vertically upward or downward on the climbing rail 34.

Once the first floor plate 22A has been raised to the first floor final elevation, then the first floor plate 22A is attached to the climbing rail 34 at the first floor final elevation. Preferably, the location at which the first floor plate 22A is attached to the climbing rail 34 is disposed vertically above the first floor plate 22A, such that a worker making the connection does not have to be located underneath the first floor plate 22A prior to the first floor plate 22A being securely fastened to the climbing rail 34.

For example, attaching the first floor plate 22A to the climbing rail 34 may include inserting the pin 66 through holes 42 in the climbing rail 34 aligned with the holes 64 in the connecting rails 58A, 58B. The aligned holes 42 of the climbing rail 34 and the connecting rails 58A, 58B are disposed above the first floor plate 22A, such that the pin 66 may be inserted through the aligned holes from a position above the first floor plate 22A. It should be appreciated that multiple pins 66 may be used to secure the first floor plate 22A to the climbing rail 34, with each pin 66 extending through respective holes 64 in the connecting rails 58A, 58B that are aligned with a respective hole 42 in the climbing rail 34.

The connecting rails 58A, 58B of the first floor plate 22A are attached to the hat beam 32, such that the building 26 load forces are transferable between the connecting rails 58A, 58B and the hat beam 32. The connecting rails 58A, 58B may be attached to the hat beam 32 in any suitable manner, such as but not limited to a bolted and/or welded connection. By attaching the connecting rails 58A, 58B of the subsequent floor plates 22 together and to the foundation 28, the connecting rails 58A, 58B form a structural column of the building 26, through which the building 26 load forces may be transmitted.

Once the first floor plate 22A has been attached to the climbing rail 34, the climbing jack 44 may be moved vertically downward to the initial jack elevation. Because the climbing jack 44 was located underneath the first floor plate 22A while raising the first floor plate 22A, the climbing jack 44 does not need to be detached from the climbing rail 34, and instead may be controlled by the computer to move vertically downward on the climbing rail 34 using the reverse of the process described above for moving vertically up the climbing rail 34.

The second floor plate 22B may then be constructed around the periphery of the vertical support core 24 at the ground elevation. Constructing the second floor plate 22B includes constructing the structural support system 54 of the second floor plate 22B, which includes connecting the connecting rails 58A, 58B to the frame members 56 of the structural support system 54 of the second floor plate 22B. The second floor plate 22B is constructed in a similar manner as the first floor plate 22A, with the connecting rails 58A, 58B of the second floor plate 22B positioned adjacent to and parallel with the climbing rail 34. In the embodiment described and illustrated herein, the connecting rails 58A, 58B of the second floor plate 22B include a portion that extends upward from the second floor plate 22B for attachment to the lower portion of the connecting rails 58A, 58B of the first floor plate 22A. Additionally, the connecting rails 58A, 58B of the second floor plate 22B may include a shorter, lower portion that extends downward from the second floor plate 22B to attachment to a subsequent lower level floor plate 22.

Referring to FIG. 6, once the second floor plate 22B is constructed, the climbing jack 44 is moved vertically upward on the climbing rail 34 to raise the second floor plate 22B to a second floor final elevation. Once the second floor plate 22B has been raised to the second floor final elevation, then the second floor plate 22B is attached to the climbing rail 34 at the second floor final elevation. Preferably, the location at which the second floor plate 22B is attached to the climbing rail 34 is disposed vertically above the second floor plate 22B, such that the worker making the connection does not have to be located underneath the second floor plate 22B prior to the second floor plate 22B being securely fastened to the climbing rail 34. The second floor plate 22B may be attached to the climbing rail 34 in the same manner as the first floor plate 22A is attached to the climbing rail 34 described above.

As shown in FIG. 6, the connecting rails 58A, 58B of the second floor plate 22B are attached to the connecting rails 58A, 58B of the first floor plate 22A such that the building 26 load forces are transferable between the connecting rails 58A, 58B of the second floor plate 22B and the hat beam 32. By attaching the connecting rails 58A, 58B of the subsequent floor plates 22 together and to the foundation 28, the connecting rails 58A, 58B form a structural column of the building 26, through which the building 26 load forces may be transmitted. Once the second floor plate 22B has been attached to the climbing rail 34, the climbing jack 44 may be moved vertically downward to the initial jack elevation and the process repeated in a descending sequential order to construct and attach the remaining floor plates 22 to the climbing rail 34.

Similar to the climbing rail 34, the connecting rails 58A, 58B form a structural load path for transferring building 26 load forces to the foundation 28. For example, the building 26 load forces may be transferred directly from the connecting rails 58A, 58B to the foundation 28. Alternatively, the building 26 load forces may be transferred to the hat beam 32, which in turn transfers the building 26 load forces to the vertical support core 24 and/or the climbing rail 34, which in turn may transfer the building 26 load forces to the foundation 28. The building construction system 20 described herein provides multiple different load paths for the building 26 load forces. Accordingly, should one of the available load paths be damaged, the building 26 still maintains two other viable load paths to support the building 26 load forces.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A building construction system comprising:

a vertical support core configured to transfer building load forces to ground;

a climbing rail attached to an exterior surface of the vertical support core, wherein the climbing rail extends vertically with and parallel to the vertical support core, and wherein the climbing rail includes a plurality of holes each spaced apart vertically relative to each other along the climbing rail;

a climbing jack attached to the climbing rail;

a floor plate positioned around a periphery of the vertical support core, the floor plate including a structural support system having a plurality of frame members attached together and at least one connecting rail fixedly attached to the frame members, wherein the at least one connecting rail is disposed adjacent to and substantially parallel with the climbing rail, and wherein the at least one connecting rail includes a plurality of holes each spaced apart vertically relative to each other along the at least one connecting rail;

wherein the climbing jack is configured to move up the climbing rail to raise the floor plate to a final elevation; and a pin disposed within and extending through one of the holes of the climbing rail and one of the holes of the at least one connecting rail aligned therewith to secure the floor plate to the climbing rail.

2. The building construction system set forth in claim 1, wherein the at least one connecting rail includes a first connecting rail disposed on a first lateral side of the climbing rail, and a second connecting rail disposed on an opposing second lateral side of the climbing rail.

3. The building construction system set forth in claim 1, further comprising a hat beam disposed above and attached to the vertical support core, with each of the climbing rail and the at least one connecting rail attached to the hat beam and operable to transmit building load forces therebetween.

4. The building construction system set forth in claim 1, further comprising a foundation supporting the vertical support core, with each of the climbing rail and the at least one connecting rail attached to the foundation and operable to transmit building load forces therebetween.

5. The building construction system set forth in claim 1, wherein the climbing jack includes a pin climbing jack including an upper post for engaging the holes of the climbing rail, a lower post for engaging the holes of the climbing rail, and a hydraulic jack operable to extend and retract to move the upper post and the lower post away from and toward each other.

6. The building construction system set forth in claim 1, further comprising a push block disposed between and interconnecting the climbing jack and the floor plate while the climbing jack is raising the floor plate to the final elevation of the floor plate.

7. The building construction system set forth in claim 1, further comprising a rigid connection securely attaching the climbing rail to the vertical support core.

8. A method of constructing a building, the method comprising:

constructing a vertical support core of the building;

attaching a climbing rail to an exterior surface of the vertical support core, wherein the climbing rail extends vertically and is substantially parallel with the vertical support core;

constructing a first floor plate around a periphery of the vertical support core at a ground elevation;

constructing a structural support system of the first floor plate including a plurality of frame members attached together and at least one connecting rail fixedly attached to the frame members, the at least one connecting rail positioned adjacent to and substantially parallel with the climbing rail, wherein each of the climbing rail and the at least one connecting rail include a plurality of holes spaced apart vertically relative to each other;

attaching a climbing jack to the climbing rail at an initial jack elevation below the first floor plate, such that the climbing jack supports the first floor plate;

moving the climbing jack vertically upward on the climbing rail to raise the first floor plate to a first floor final elevation; and attaching the first floor plate to the climbing rail at the first floor final elevation by inserting a pin through aligned said holes in each of the climbing rail and the at least one connecting rail.

9. The method set forth in claim 8, further comprising:

constructing a second floor plate around the periphery of the vertical support core at the ground elevation;

moving the climbing jack vertically upward on the climbing rail to raise the second floor plate to a second floor final elevation; and attaching the second floor plate to the climbing rail at the second floor final elevation.

10. The method set forth in claim 8, wherein the aligned holes are disposed above the first floor plate, such that the pin is configured to be inserted through the aligned holes from a position above the first floor plate.

11. The method set forth in claim 8, wherein the at least one connecting rail includes a first connecting rail disposed on a first lateral side of the climbing rail, and a second connecting rail disposed on an opposing second lateral side of the climbing rail.

12. The method set forth in claim 8, wherein attaching the first floor plate to the climbing rail at the first floor final elevation is further defined as attaching the first floor plate to the climbing rail at a location disposed above the first floor plate.

13. The method set forth in claim 8, further comprising moving the climbing jack vertically downward to the initial jack elevation.

14. The method set forth in claim 13, wherein moving the climbing jack vertically downward is further described as moving the climbing jack vertically downward without detaching the climbing jack from the climbing rail.

15. The method set forth in claim 8, wherein constructing the vertical support core includes constructing a foundation of the vertical support core operable to transfer building load forces to ground.

16. The method set forth in claim 15, further comprising attaching the climbing rail to the foundation of the vertical support core such that building load forces are transferable between the climbing rail and the foundation of the vertical support core.

17. The method set forth in claim 8, further comprising attaching a hat beam on top of the vertical support core, such that building load forces are transferable between the hat beam and the vertical support core.

18. The method set forth in claim 17, further comprising attaching the climbing rail to the hat beam such that building load forces are transferable between the climbing rail and the hat beam.

19. The method set forth in claim 17, further comprising attaching the at least one connecting rail to the hat beam such that the building load forces are transferable between the at least one connecting rail and the hat beam.

20. The method set forth in claim 17, further comprising attaching the at least one connecting rail to the foundation of the vertical support core such that the building load forces are transferable between the at least one connecting rail and the foundation of the vertical support core.

* * * * *